US005388821A

United States Patent [19]

Blackburn

[11] Patent Number: 5,388,821

[45] Date of Patent: Feb. 14, 1995

[54] FORCE LIMITING ADJUSTABLE BASKETBALL GOAL

[76] Inventor: Michael J. Blackburn, 505 E. Washington St., Morris, Ill. 60450

[21] Appl. No.: 104,008

[22] Filed: Aug. 10, 1993

[51] Int. Cl.[6] ..... A63B 63/08

[52] U.S. Cl. ..... 273/1.5 R

[58] Field of Search ..... 273/1.5 R, 1.5 A

[56] References Cited

U.S. PATENT DOCUMENTS

| | | | |
|---|---|---|---|
| 4,465,277 | 8/1984 | Dittrich | 273/1.5 R |
| 4,781,375 | 11/1988 | Nye | 273/1.5 R |
| 4,801,142 | 1/1989 | Friesen | 273/1.5 R |
| 4,805,904 | 2/1989 | Nye | 273/1.5 R |
| 5,037,092 | 8/1991 | Blackburn | 273/1.5 R |
| 5,133,547 | 7/1992 | Pardi | 273/1.5 R |

*Primary Examiner*—William H. Grieb
*Attorney, Agent, or Firm*—Cherskov & Flaynik

[57] ABSTRACT

A force limiting adjustable basketball goal includes a support member and counter-weight to rotate a basketball goal around a support pole to vary the rim elevation above a playing surface. An anchor chain secured to the pole and counter-weight includes a safety link that breaks when a pre-selected force is exerted upon the rim by a player dunking a basketball or hanging on the rim. When the safety link breaks, the basketball goal falls slowly to the playing surface, thereby requiring the replacement of the safety link before play is allowed to resume.

8 Claims, 9 Drawing Sheets

FORCE LIMITING ADJUSTABLE BASKETBALL GOAL

BACKGROUND OF THE INVENTION

1. Field of the Invention

The present invention relates to adjustable basketball goals and, more particularly, to basketball goals that limit the force exerted on the basketball rim, thereby avoiding damage to the rim and support structure and injury to the player.

2. Background of the Prior Art

Regulation basketball requires a rim elevation of ten (10) feet above the playing surface. The elevation makes participation difficult for children and some adults. An adjustable basketball goal provides different elevations above a playing surface for people of all ages to enjoy the game. However, being able to lower the basketball goal makes the goal much more accessible for dunk shots and for players to hang on the rim.

Prior art basketball goals (see U.S. Pat. Nos. 5,133,547; 4,801,142; and 4,465,277) utilize complex and expensive designs that include complicated support framework, resilient components, winch assemblies and intricate biasing techniques to absorb the total force exerted upon a basketball rim, irrespective of the magnitude of the force. Simply stated, prior art basketball goal designs absorb the total applied force, then return to their original elevation. Over time, this design required replacing expensive components and substantial downtime to replace the components. It is not uncommon to witness college and professional basketball games during which a player tears off a basketball rim and shatters the fiberglass backboard, or breaks the supporting structure, both examples causing substantial game delays and repair expenses.

SUMMARY Of THE INVENTION

It is an object of the present invention to overcome many of the disadvantages associated with adjustable basketball goals receiving the total force exerted on the basketball rim. Other objects are to avoid the necessity of including force absorbing components that maintain a pre-selected rim elevation; to reduce the number of components to construct the basketball goal; to reduce the costs to construct the basketball goal; to reduce the maintenance requirements of the basketball goal; to simplify the support framework; to simplify the design that varies rim elevation; to reduce the time to change rim elevation; to provide a force limiting adjustable basketball goal that limits the magnitude of the force exerted on the basketball rim.

The present invention provides a force limiting adjustable basketball goal comprising a backboard having a basketball hoop attached thereto, a support member having a first end and a second end with said first end pivotally connected to said backboard, a counter-weight member connected to said second end of said support member, stanchion means, the support members pivotally connected to said stanchion means a predetermined distance between said first end and said second end at said support member, means for positioning the height of said backboard, said counter-weight member and said positioning means allowing rapid height adjustment of said basketball hoop within a predetermined range, and means for limiting the maximum allowable force receivable on said basketball hoop, said force limiting means and said counter-weight member restricting the downward acceleration of said back board should said maximum allowable force be exceeded.

BRIEF DESCRIPTION OF THE DRAWINGS

These and other objects, advantages and novel features of the present invention, as well as details of an illustrative embodiment thereof, will be more fully understood from the following detailed description and attached drawings, wherein.

DETAILED DESCRIPTION OF THE PREFERRED EMBODIMENT

Figure 1:
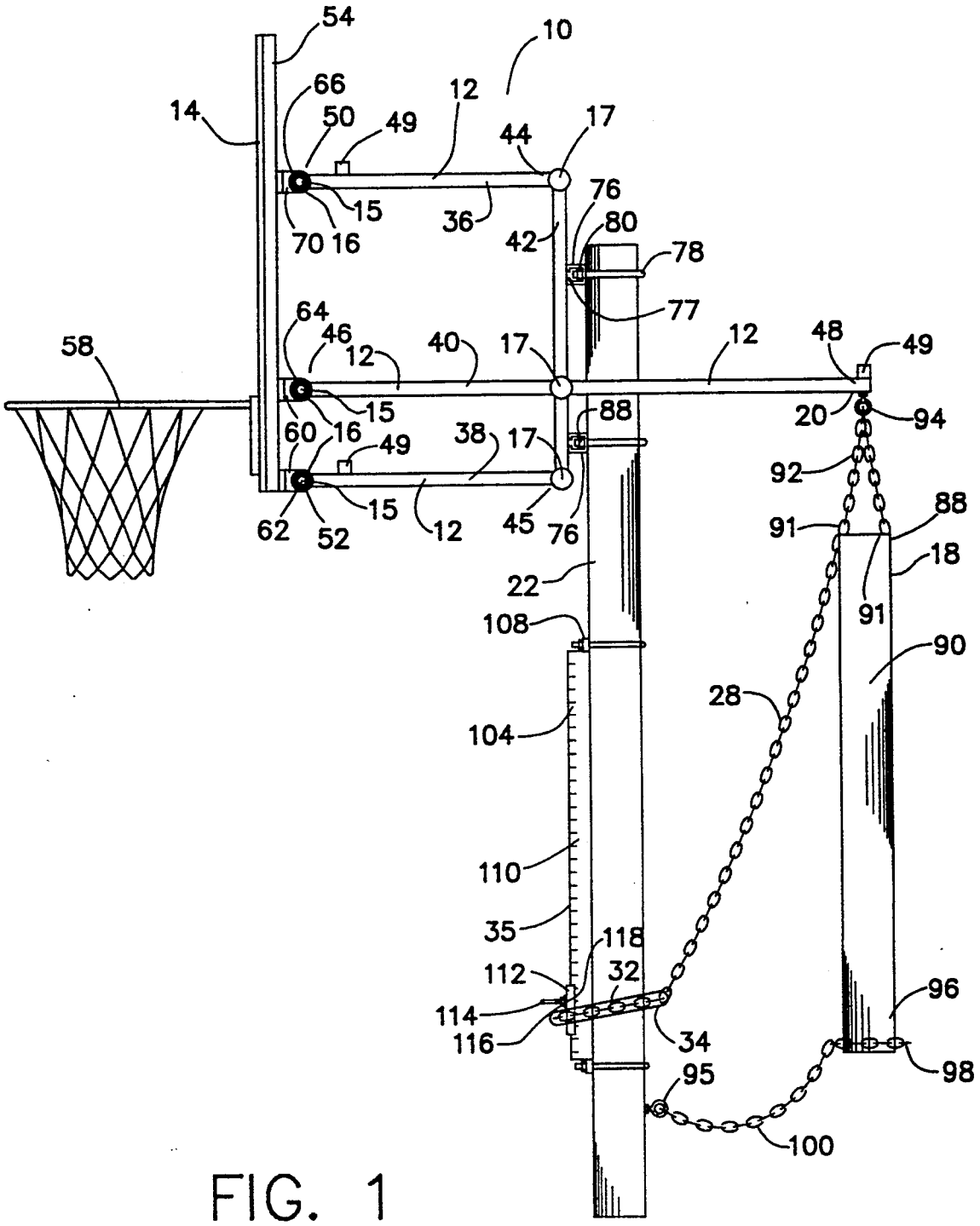
FIG. 1 is a side elevation view of a force limiting adjustable basketball goal in accordance with the present invention.

Referring now to the Figures, a force limiting adjustable basketball goal in accordance with this invention is denoted by numeral 10. The force limiting adjustable basketball goal 10 includes a support member 12 that acts as a balancing structure for a basketball goal 14 pivotally connected by first pivot members 15 to a first end 16 of the support member 12 and a counter-weight 18 connected to a second end 20 of the support member 12. The support member 12 is pivotally connected by second pivot members 17 at a pre-determined point between the first and second ends (16 and 20) to a support pole 22 or other stanchion-type structure. An eye bolt 24 (see FIG. 2) is secured to the second end 20 of the support member 12. A safety link 26 (see FIG. 2) is connected to the eye bolt 24. An anchor chain 28 has a first link 30 connected to the safety link 26, The anchor chain 28 has a looped second end 32 encircling the support pole 22. A casing 34 covers the chain links forming the looped second end 32 of the anchor chain 28, thereby forming a barrier between the looped second end 32 and the support pole 22. A height indicator 35 is vertically attached to the support pole 22 at a pre-determined position.

Figure 2:
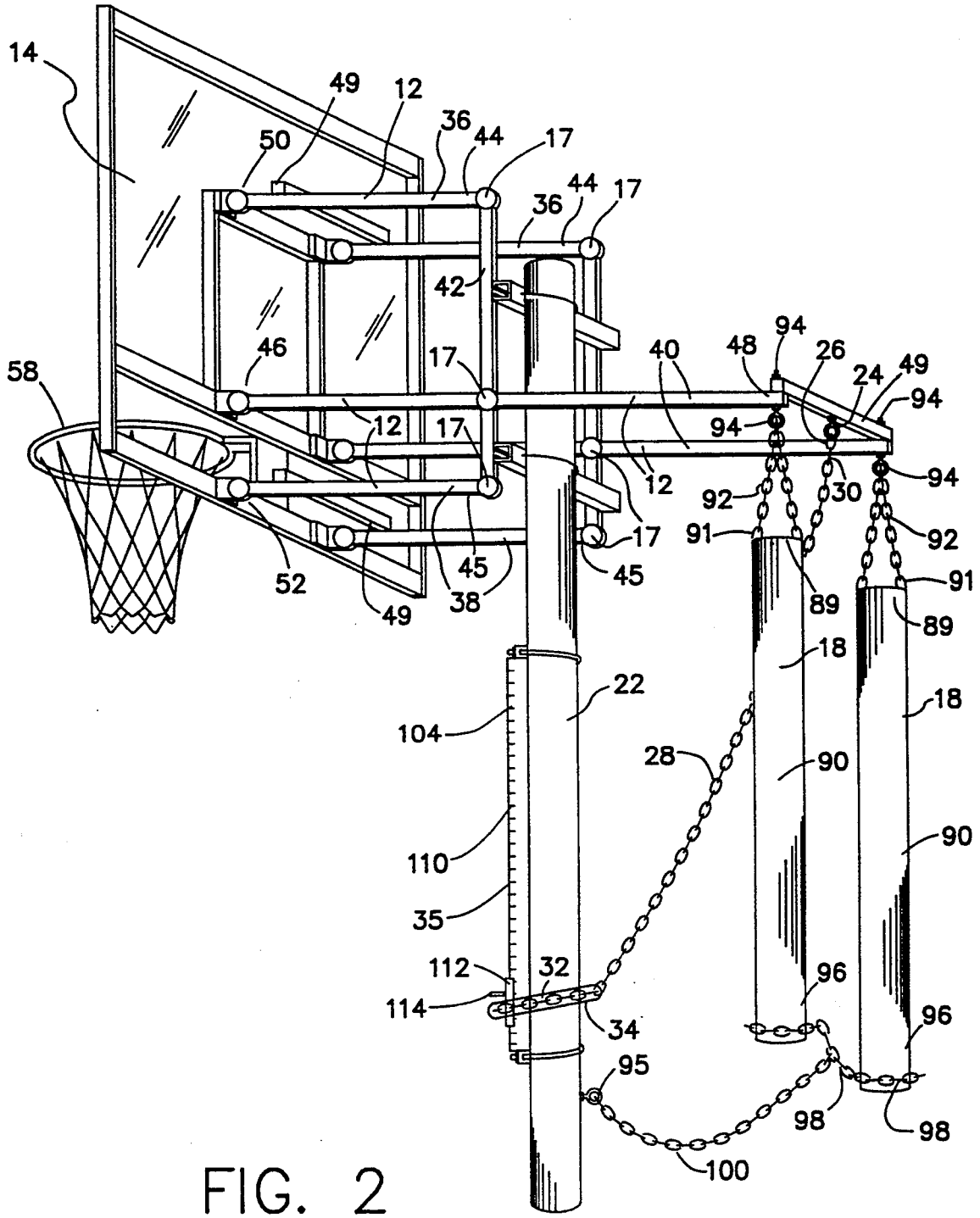
FIG. 2 is a perspective view of a force limiting adjustable basketball goal in accordance with the present invention.

Referring to FIG. 2, a perspective view of a force limiting adjustable basketball goal in accordance with this invention is shown. The support member 12 includes two upper support bars 36, two lower support bars 38, two balance bars 40 positioned between the upper and lower support bars, and two vertical mounting bars 42 pivotally connected by second pivot members 17 to second ends (44 and 45) of respective upper and lower bars (36 and 38). The vertical mounting bars 42 are also pivotally connected by second pivot members 17 to respective balance bars 40 approximately midway between first and second ends (46 and 48). Lateral reinforcement bars 49 are perpendicularly secured to upper support bars 36 near first ends 50, lower support bars 38 near first ends 52, and balance bars 40 near second ends 48.

The bars forming the support member 12 are constructed of tubular metal having a lateral dimension approximately one inch in length and a substantially square cross-section. The longitudinal dimension of the balance bar 40 is approximately four feet. The longitudinal dimension of the upper and lower support bars (36 and 38) is approximately two feet. The distance between the inner and outer walls of the tube cross-section is approximately one-quarter inch, thereby providing sufficient strength to support the basketball goal 14, counter-weight 18, and force generated by a player dunking a basketball or hanging on the goal 14.

Figure 3:
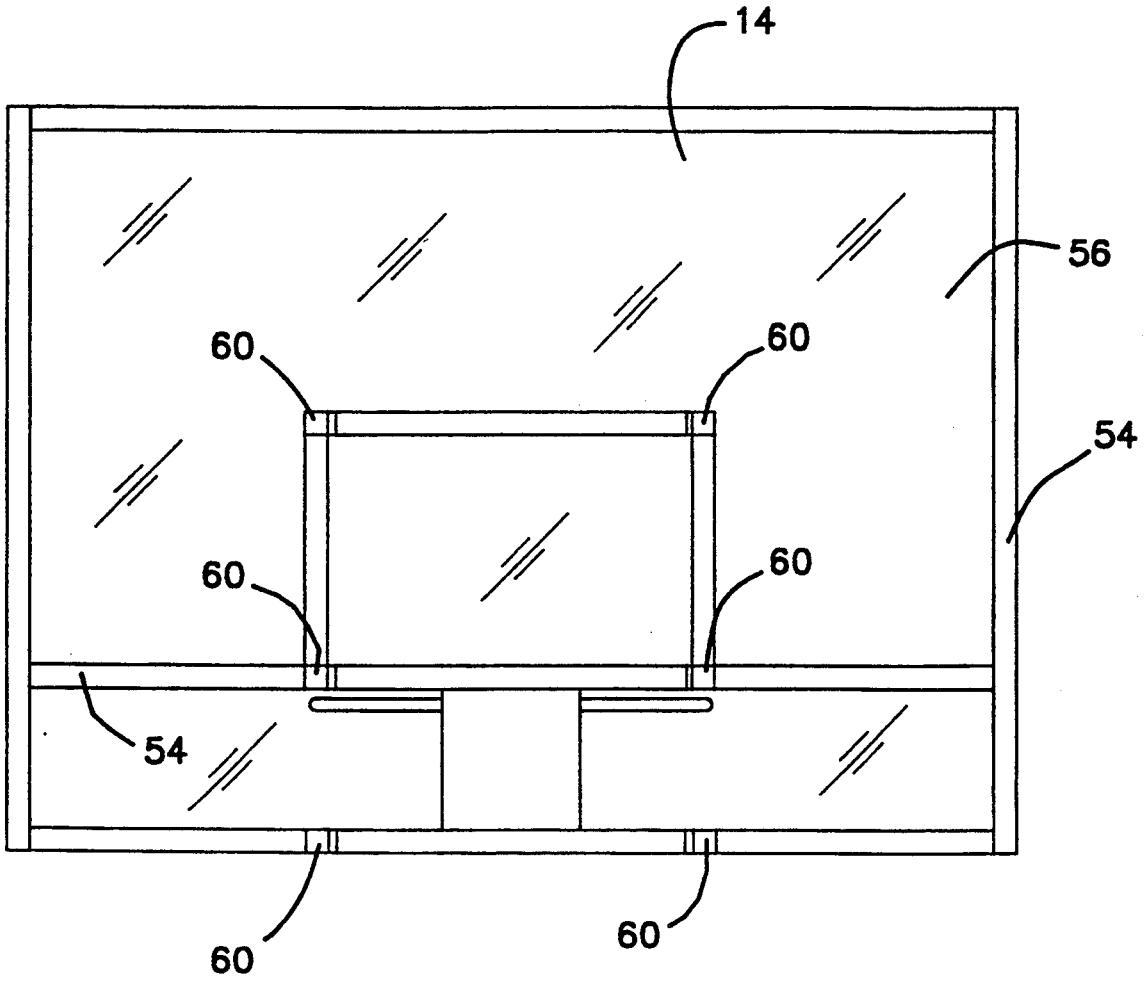
FIG. 3 is a rear elevation view of the basketball goal.

Referring to FIG. 3, a rear elevation view of the basketball goal 14 is shown. The basketball goal 14 is described in U.S. Pat. No. 5,037,092 (having the same inventor as the present application) and is incorporated herein by reference and made a part hereof. The basketball goal 14 includes tubular metal bars 54 attached to a backboard 56. The bars 54 are capable of supporting the backboard 56 and a basketball rim 58 attached thereto. Angle plates 60 are secured to the bars 54 at six positions. The angle plates 60 are positioned to receive the respective first ends of the upper, lower and balance bars such that when viewing the support member 12 (see FIG. 1) from the side when connected to the basketball goal, the upper, lower and balance bars are parallel irrespective of the elevation of the basketball goal 14, thereby keeping the backboard 56 perpendicular to the playing surface.

Figure 4:
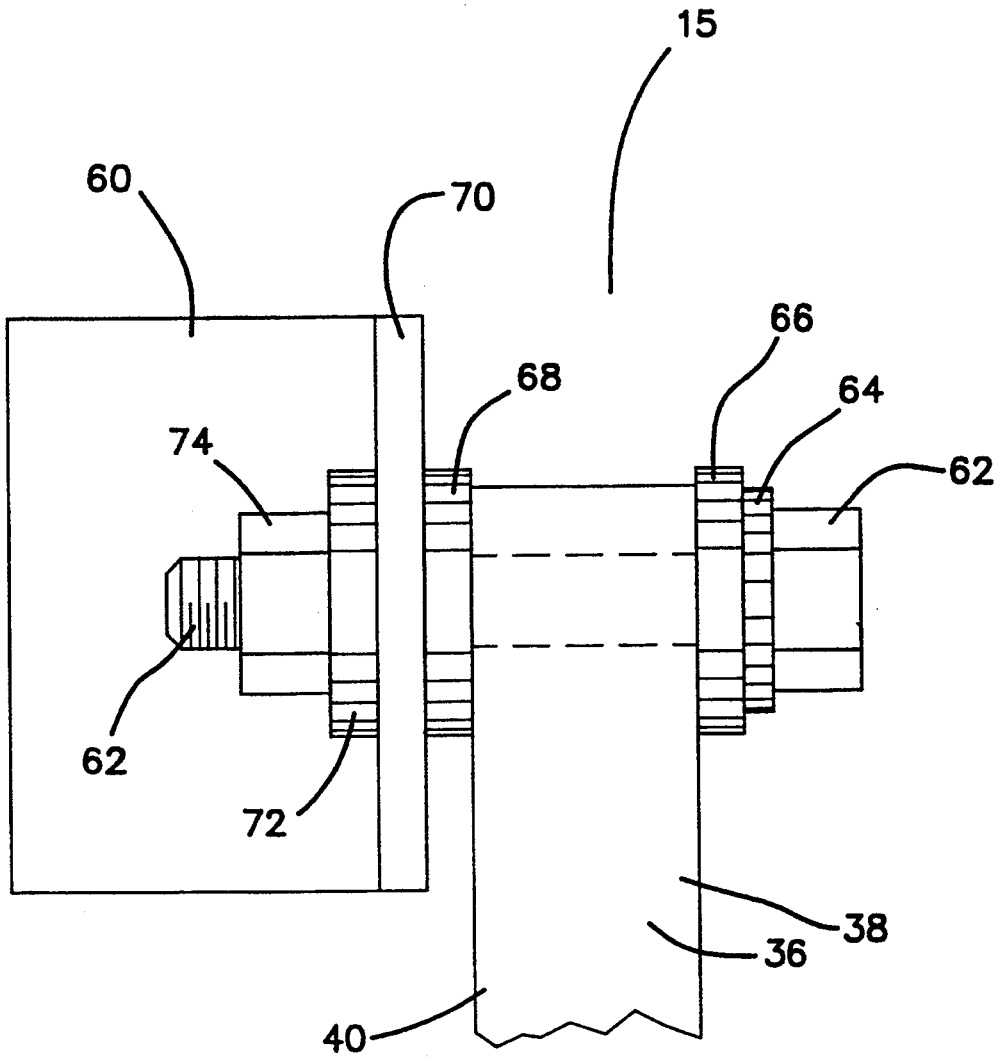
FIG. 4 is a front elevation view of a first pivot member.

Referring to FIG. 4, a front elevation view of a first pivot member 15 is shown pivotally connecting an angle plate 60 to the first ends of the upper or lower support bars (36 and 38) or the balance bar 40. The pivot member 15 includes a bolt 62 extending through a washer 64, a first teflon bearing 66, a first end of any of the aforementioned bars, a second teflon bearing 68, an angle portion 70 of the angle plate 60, a third teflon bearing 72 and retaining nut 74. FIG. 4 is typical for all six first pivot members 15. The construction allows the first end 16 (see FIG. 1) of the support member 12 to position the basketball goal 14 at multiple elevation with minimal resistance.

Figure 5:
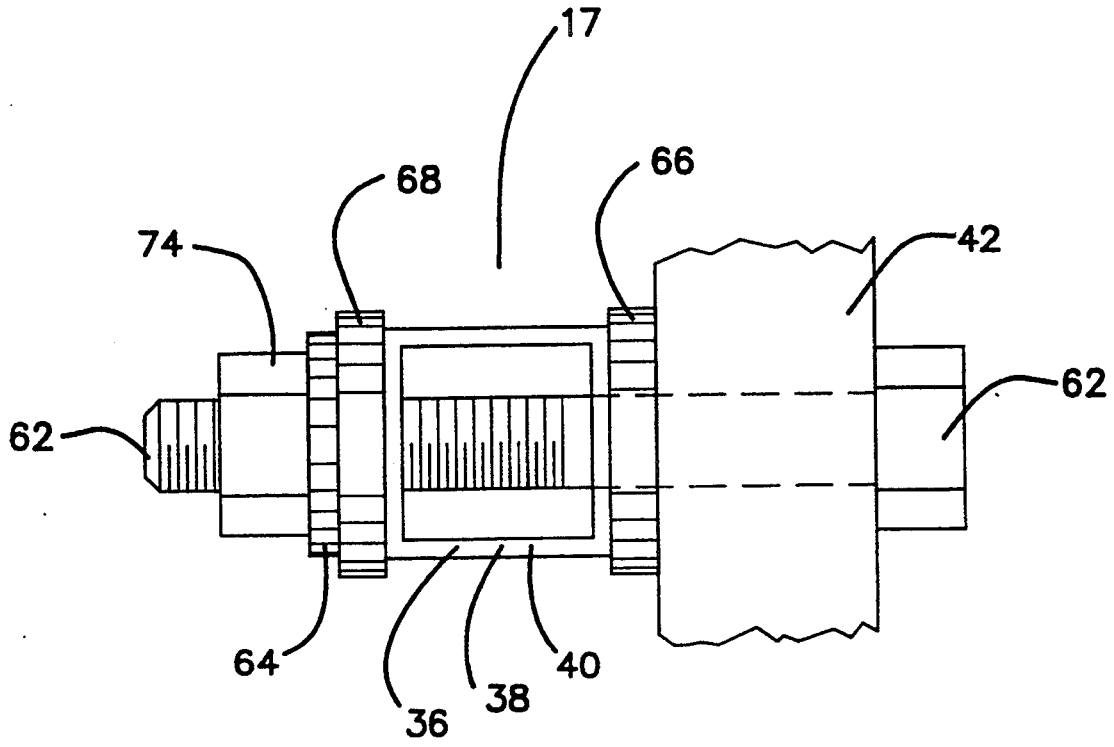
FIG. 5 is a front elevation view of a second pivot member.

Referring to FIG. 5, a front elevation view of a second pivot member 17 is shown pivotally connecting the vertical mounting bar 42 to the second ends (44 and 45, see FIG. 1) of the upper or lower support bars (36 and 38) or the midpoint of the balance bars 40. The pivot member 17 includes a bolt 62 extending through the vertical mounting bar 42, a first TEFLON bearing 66, a second end of either the upper or lower support bars (36 and 38) or the midpoint of the balance bar 40, a second TEFLON bearing 68, a washer 64 and retaining nut 74. FIG. 5 is typical for all six second pivot members 17. The construction allows the support member 12 (see FIG. 1) to be moved to multiple positions with minimal resistance when connected to the vertical mounting bar 42.

Figure 7:
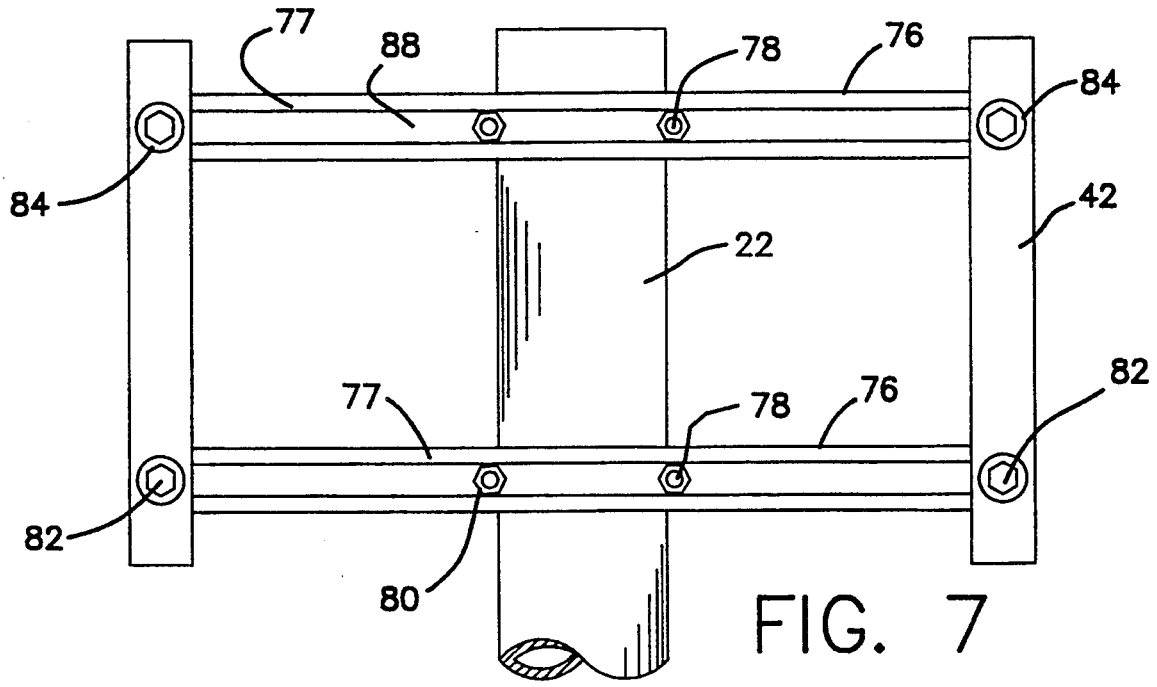
FIG. 7 is a front elevation view of a vertical mounting bar connected to a support pole.
Figure 6:
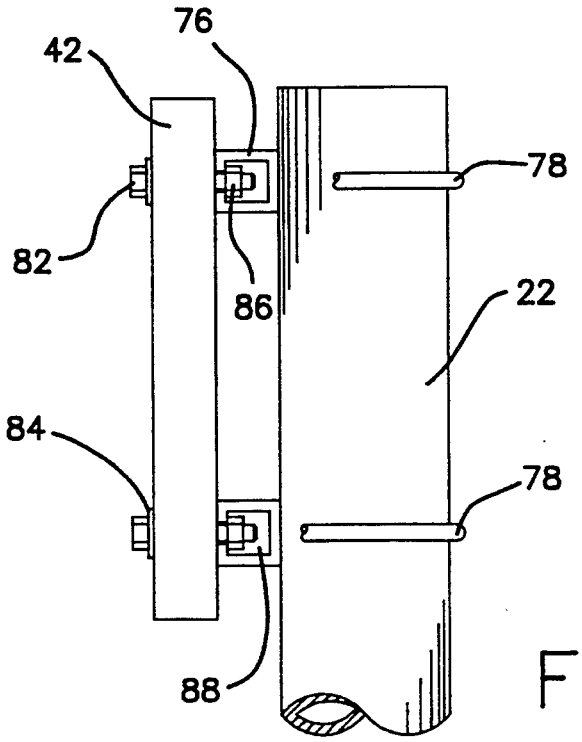
FIG. 6 is a side elevation view of a vertical mounting bar connected to a support pole.

Referring to FIGS. 6 and 7, a side elevation view (FIG. 6) and front elevation view (FIG. 7) of the vertical mounting bar 42 connected to the support pole 22 are shown. The support pole 22 is cylindrical, approximately six inches in diameter and having a longitudinal dimension of ten feet from the playing surface. The support pole 22 has a cross-sectional dimension of approximately one-quarter inch between inner and outer walls. The support pole 22 is fabricated from steel providing strength to support the support member 12 (see FIG. 1), counter-weight 18, basketball goal 14, and any force exerted thereupon.

Two slotted channel bars 76 having nut retaining rims 77 are horizontally mounted to the support pole 22 by utilizing "U" bolts 78 that extend through the channel bars 76 and are secured in place by securing nuts 80. Each vertical mounting bars 42 is attached to both horizontal channel bars 76 by utilizing a bolt 82 extending through a washer 84, through the vertical mounting bar 42, then through a retaining nut 86 that is inserted and retained within the channel bar slot 88 by nut retaining rims 77, thereby rigidly securing the vertical mounting bars 42 to the support pole 22.

Referring again to FIG. 2, counter-weight; 18 is shown connected to the lateral reinforcement bar 49 that is attached to the second ends 48 of the balance bars 40. The counter-weight 18 includes two sections of metal pipe 90 approximately four feet long, four inches in diameter, and each Weighing approximately twenty-five pounds. Two support chains 92 are oppositely connected to each upper end 89 of each pipe 90 by a clamp 91. The two support chains 92 for each pipe are joined at an eye bolt 94 that is connected to lateral reinforcement bar 49. The lower ends 96 of each pipe 90 are joined by a connecting chain 98 that is secured to the support pole 22 by a slack retaining chain 100 to prevent the rim 58 from lowering less than three feet above the playing surface. The anchor chain 28 has the second end 32 circumferentially looped around and secured to the support pole 22 above the retaining chain eye bolt 35. The anchor chain 28 has first link 30 linked to the safety link 26. The safety link 26 is then hooked to eye bolt 94. Eye bolt 24 is secured to the midpoint of lateral reinforcement bar 49, thereby positioning the anchor chain 28 equidistant from the two metal pipes 90.

Figure 8:
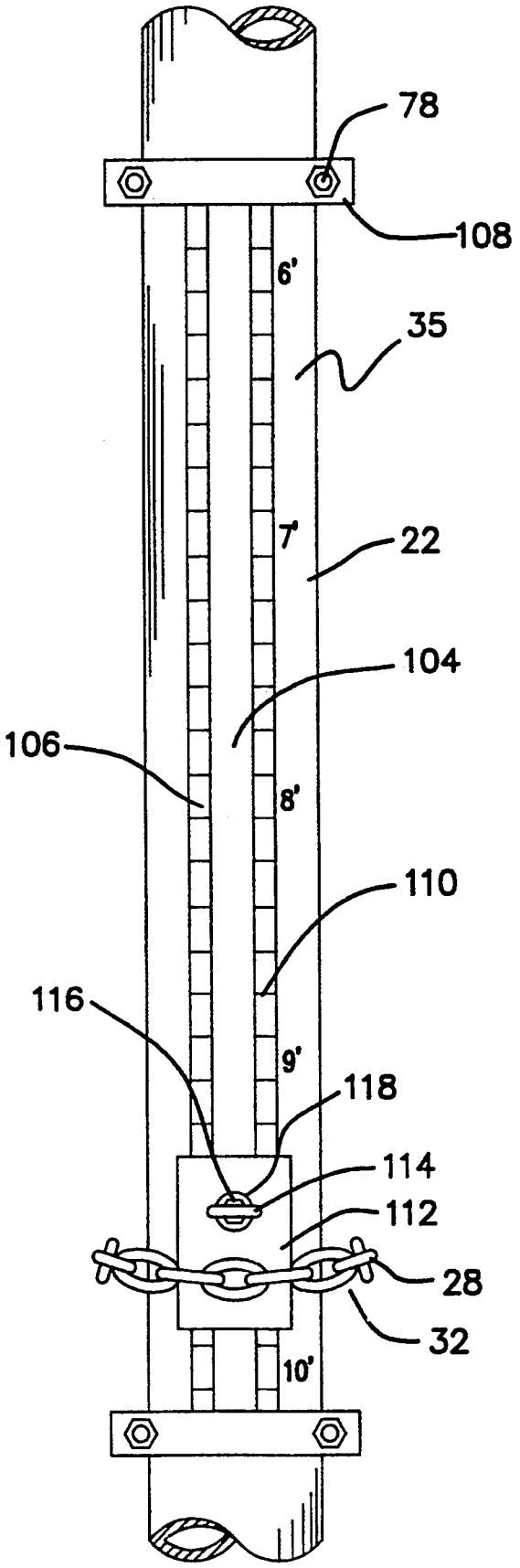
FIG. 8 is a front elevation view of a height indicator mounted to a support pole.
Figure 9:
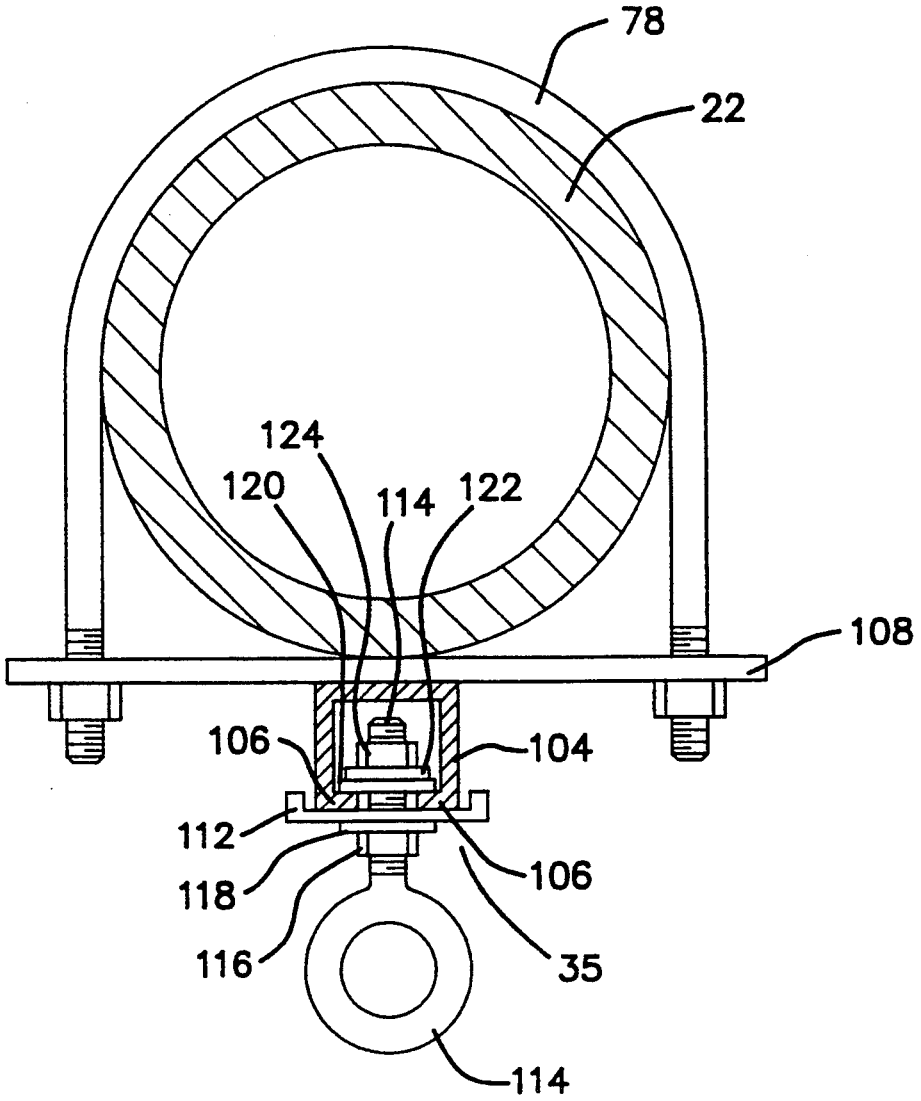
FIG. 9 is a top elevation view of a height indicator mounted to a support pole.

Referring to FIGS. 8 and 9, front (FIG. 8) and top (FIG. 9) elevation views of the height indicator 35 mounted to the support pole 22 are shown. The height indicator 35 includes a slotted channel bar 104 having retaining rims 106 that is vertically secured to support pole 22 by utilizing "U" bolts 78 and flat bars 108. The slotted channel bar 104 has horizontal markings 110 that continue longitudinally along the channel bar 104 to indicate the corresponding elevation of the basketball rim 58 above a playing surface. A sliding plate 112 is secured to the channel bar 104 by an eye bolt 114 that extends through a first nut 116, first washer 118, the sliding plate 112, a teflon retainer 120 that is positioned within the slotted channel bar 104 and against the retaining rims 106, a second washer 122, and a second nut 124. The longitudinal dimension of eye bolt 114 is long enough to extend through the aforementioned components without contacting the channel bar 104. Loosening the first nut 116 allows the sliding plate 112 to slide longitudinally along the channel bar 104. Tightening the first nut 116 forces the teflon retainer 120 against the retaining rims 106, thereby securing the sliding plate 112 to the channel bar 104 at the selected position. The looped end 32 of the anchor chain 28 is secured to the sliding plate 112. Thus, when the sliding plate 112 is positioned along the slotted channel bar 104, the second end 20 of the support member 12 is raised or lowered, thereby respectively raising or lowering the basketball goal 14.

Figure 10:
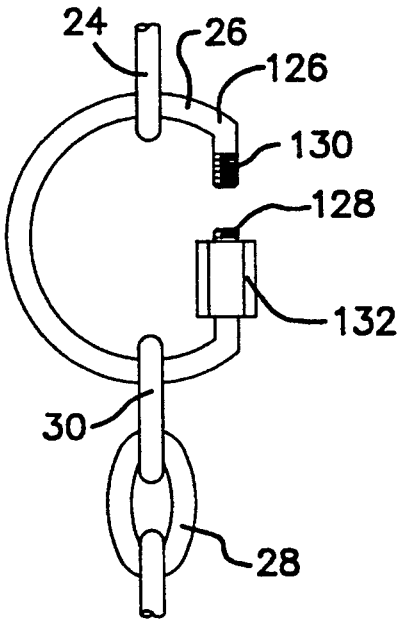
FIG. 10 is a front view of a safety link.

Referring to FIG. 10, a front view of the safety link 26 is shown. The safety link 26 is a standard manufactured component designed to break at a pre-selected force. One such component is "Rapid Link" manufactured in Taiwan. The safety link 26 includes a "C" shaped portion 126 having first and second ends (128 and 130) threaded with a link closing nut 132 positioned on the first end 128 of the portion 126. Upon receiving the first link 30 of anchor chain 28, and eye bolt 24, the link closing nut 128 is rotated, thus extending the link closing nut 128 to receive the second end 130, thereby enclosing the "C" portion 126 and securing the first link 30 and eye bolt 24 therein. Once enclosed, a force of approximately two hundred fifty pounds must develop across the first and second ends (128 and 130) to rupture the safety link 26, thereby allowing the second end 20 of the support member 12 to raise and the first end 116 and basketball goal 14 connected thereto to lower.

The force limiting adjustable basketball goal 10 operates by first selecting a desired elevation for the basketball rim 58 (see FIG. 1). First nut 116 is loosened to allow sliding plate 112 to slide to a pre-determined position at a horizontal marking 110. The sliding plate 112 is secured to channel bar 104. The basketball goal 14 is approximately ten pounds heavier than the counterweight 18 and both the basketball goal 14 and counterweight 18 are two feet from the pivot point formed by the vertical mounting bar 42 and the second pivot members 17, thereby forcing the anchor chain 28 to remain tensile, the support member 12 to pivot about second pivot members 17 (in essence forming a teeter-tawter), and the basketball goal 14 to pivot about first pivot members 15. Upon positioning the basketball goal 14 to the desired elevation, play is begun. Should a player dunk the basketball or hang on the rim 58 with enough force to exceed the safety link 26 (see FIG. 2) setting, the safety link 26 breaks, thereby allowing the basketball goal 14 to slowly fall towards the playing surface. The force selected for the safety link 26 to break will vary depending upon the size of the players and selected elevation.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the United States is:

1. A force limiting adjustable basketball goal comprising:

a backboard having a basketball hoop attached thereto;

a support member having a first end and a second end with said first end pivotally connected to said backboard;

a counter-weight member connected to said second end of said support member;

stanchion means, the support member pivotally connected to said stanchion means a pre-determined distance between said first end and said second end of said support member;

means for positioning the height of said backboard, said counter-weight member and said positioning means allowing rapid height adjustment of said basketball hoop within a pre-determined range; and means for limiting the maximum allowable force receivable on said basketball hoop, said force limiting means and said counter-weight member restricting the downward acceleration of said backboard should said maximum allowable force be exceeded.

2. The adjustable basketball goal of claim 1, wherein said support member further at least one vertical rod vertically attached to said stanchion means;

at least one support bar having a first end pivotally connected to said backboard and a second end connected to said counter-weight, said support bar being pivotally connected to said vertical rod a pre-determined distance between said first end and said second end of said Support bar; and a plurality of support arms having a first end pivotally connected to said back board and a second end pivotally connected to said vertical rod, said support arms being parallel with said support bar.

3. The adjustable basketball goal of claim 1, wherein said stanchion means includes a vertical stand.

4. The adjustable basketball goal of claim 1, wherein said positioning means includes a height indicator mounted to said stanchion means:

an anchor member having a slideable first end connected to said stanchion means and a second end integrally connected to said second end of said support member; and securing means for securing the slideable first end of said anchor member to a pre-determined portion of said stanchion means having said height indicators mounted thereon.

5. The anchor member claimed in claim 4, said anchor member including a plurality of chain links.

6. The anchor member claimed in claim 4, said slideable first end includes a loop circumferentially wrapped around said stanchion means.

7. The adjustable basketball goal of claim 4, wherein said securing means includes a sleeve encasing said slidable first end of said .anchor member, said sleeve and said counter-weight maintaining placement of said slideable first end upon said predetermined portion of said stanchion means having said height indicator mounted thereon.

8. The adjustable basketball goal of claim 1, wherein said force limiting means includes a safety link having a breaking point corresponding to a pre-determined maximum allowable force exerted upon said adjustable basketball goal, said safety link connecting said second end of said anchor member to said second end of said support member, thereby isolating said anchor member from said support member upon a force being exerted on said basketball goal exceeding said pre-determined maximum allowable force.

* * * * *

UNITED STATES PATENT AND TRADEMARK OFFICE

CERTIFICATE OF CORRECTION

PATENT NO. : 5,388,821
DATED : February 14, 1995
INVENTOR(S) : MICHAEL J. BLACKBURN It is certified that error appears in the above-indentified patent and that said Letters Patent is hereby corrected as shown below:

| | |
|---|---|
| Column 4, Line 18, | Cancel ";"; |
| Column 4, Line 35, | Cancel "35" and insert --114--; |
| Column 4, Line 37, | Cancel "94" and insert --24--; |
| Column 5, Line 17, | Cancel "116" and insert --16--; |
| Column 5, Line 26, | After "18", insert --,--; |
| Column 6, Line 13, | Cancel "further" and insert --further comprises--. |
| Column 6, Line 45, | Before the word "anchor", cancel ".". |

Signed and Sealed this

Twenty-eighth Day of November 1995

*Attest:*

Bruce Lehman

BRUCE LEHMAN

*Attesting Officer*

*Commissioner of Patents and Trademarks*